US008533878B2

(12) United States Patent
Wu

(10) Patent No.: US 8,533,878 B2
(45) Date of Patent: Sep. 17, 2013

(54) HOSPITAL BED

(76) Inventor: Shiou-Jhen Wu, Banciao (TW)

( * ) Notice: Subject to any disclaimer, the term of this patent is extended or adjusted under 35 U.S.C. 154(b) by 138 days.

(21) Appl. No.: 13/239,505

(22) Filed: Sep. 22, 2011

(65) Prior Publication Data

US 2013/0074266 A1 Mar. 28, 2013

(51) Int. Cl.
*A47B 7/02* (2006.01)

(52) U.S. Cl.
USPC ..... 5/616; 5/610; 5/611

(58) Field of Classification Search
USPC ..... 5/11, 53.1, 610, 611, 616
See application file for complete search history.

(56) References Cited

U.S. PATENT DOCUMENTS 5,134,731 A * 8/1992 Quintile et al. ..... 5/11
5,802,639 A * 9/1998 Raasch et al. ..... 5/611
7,513,324 B2 * 4/2009 Bergum et al. ..... 180/65.1
7,548,001 B2 * 6/2009 Macaire ..... 310/71
7,568,538 B2 * 8/2009 Drosendahl et al. ..... 180/65.1
2001/0000828 A1 * 5/2001 Hensley ..... 5/618
2004/0078894 A1 * 4/2004 Snyder et al. ..... 5/11
2004/0148698 A1 * 8/2004 Snyder et al. ..... 5/11
2006/0053550 A1 * 3/2006 Snyder et al. ..... 5/11
2009/0044340 A1 * 2/2009 Nielsen ..... 5/618
2011/0271443 A1 * 11/2011 Serhan et al. ..... 5/11
2012/0084921 A1 * 4/2012 Serhan ..... 5/610

* cited by examiner

*Primary Examiner* — Robert G Santos
*Assistant Examiner* — Richard G Davis

(57) ABSTRACT

A hospital bed includes a frame, a head board, a foot board and an apparatus for lifting and lowering the head board and the foot board. The apparatus includes a first motor unit, a shaft unit, a gear box and a second motor unit. The first motor unit is provided beneath the frame. The shaft unit is connected to both of the head board and the foot board. The gear box is provided on a side of the first motor unit and connected to the shaft unit for lifting and lowering the head board and the foot board. The second motor unit includes a motor and a pair of wires. The motor is provided with a mandrel. The mandrel is engaged with the gear box. The second motor unit is electrically connected to the first motor unit through the pair of wires for automatically lifting and lowering the head board and the foot board.

6 Claims, 9 Drawing Sheets

HOSPITAL BED

BACKGROUND OF INVENTION

1. Field of Invention

The present invention relates to a hospital bed and, more particularly, to a hospital bed including a frame, a head board, a foot board, two motor units, a shaft unit and a gear box so that the elements can easily be connected to one another for use and detached from one another for transportation and that the frame can be lifted or lowered on the head board and the foot board in a mode or tilted on the head board and the foot board in another mode.

2. Related Prior Art

A hospital bed typically includes an apparatus for lifting and lowering a head board and a foot board. Two conventional hospital beds will be described with reference to FIGS. 1 and 2, respectively.

With reference to FIG. 1, a first conventional hospital bed includes a head board 1, a foot board 2, a dual-gear unit 3 provided below the head board 1, and another dual-gear unit 3 provided below the foot board. Thus, the head board 1 and the foot board 2 can be lifted and lowered because of the dual-gear units 3.

With reference to FIG. 2, a second conventional hospital bed includes a frame 4, a dual-gear unit 5, a head board 6 and a foot board 7. Both of the head board 6 and the foot board 7 are connected to the dual-gear unit 5. Thus, the head board 6 and the foot board 7 are lifted and lowered together with each other.

In the first and second conventional hospital beds, the head board and the foot board can be lifted and lowered. The dual-gear units are used together with shafts, cranks and other parts so that the cranks can be manually operated to lift and lower the head board and the foot board. Each of the first and second conventional hospital beds can be modified by connecting a motor unit to the dual-gear units or unit to lift and lower the head board and the foot board automatically. It however takes a considerably long period of time to dismantle each of the first and second conventional hospital beds in order to connect the motor unit to the dual-gear units or unit. The modification is difficult. The transportation of such a large amount of parts is inconvenient. Electric and/or electronic units could be damaged during the transportation.

The present invention is therefore intended to obviate or at least alleviate the problems encountered in prior art.

SUMMARY OF INVENTION

It is an objective of the present invention to provide a modular hospital bed with several units that can easily be transported and connected to one another.

It is another objective of the present invention to provide an automatic hospital bed.

To achieve the foregoing objectives, the hospital bed includes a frame, a head board, a foot board and an apparatus for lifting and lowering the head board and the foot board. The apparatus includes a first motor unit, a shaft unit, a gear box and a second motor unit. The first motor unit is provided beneath the frame. The shaft unit is connected to both of the head board and the foot board. The gear box is provided on a side of the first motor unit and connected to the shaft unit for lifting and lowering the head board and the foot board. The second motor unit includes a motor and a pair of wires. The motor is provided with a mandrel. The mandrel is engaged with the gear box. The second motor unit is electrically connected to the first motor unit through the pair of wires for automatically lifting and lowering the head board and the foot board.

In another aspect, the hospital bed includes a frame, a head board a foot board, and an apparatus for lifting and lower the head board and the foot board. The apparatus includes a motor unit, a shaft unit and a gear box. The motor unit is provided beneath the frame. The shaft unit includes first shaft and a second shaft. The first shaft is connected to the head board. The second shaft is connected to the foot board. The gear box is provided on a side of the motor unit and connected to the shaft unit for lifting and lowering the head board and the foot board.

Other objectives, advantages and features of the present invention will be apparent from the following description referring to the attached drawings.

BRIEF DESCRIPTION OF DRAWINGS

The present invention will be described via detailed illustration of two embodiments versus the prior art referring to the drawings wherein.

DETAILED DESCRIPTION OF EMBODIMENTS

Figure 1:
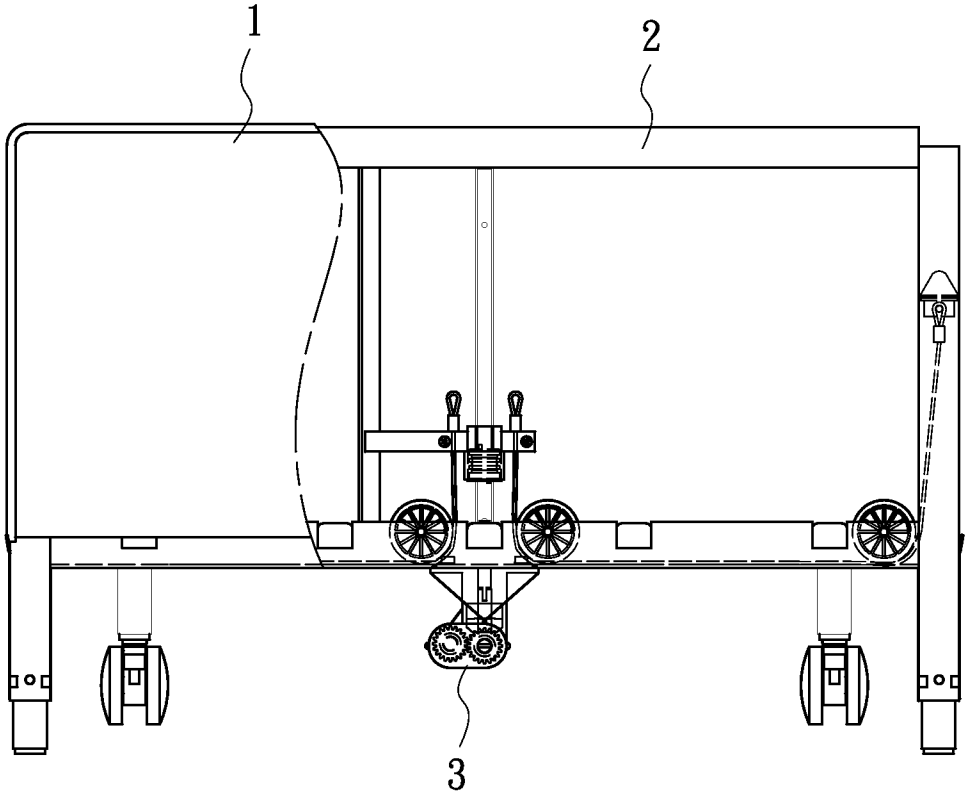
FIG. 1 is a front view of a conventional hospital bed.
Figure 2:
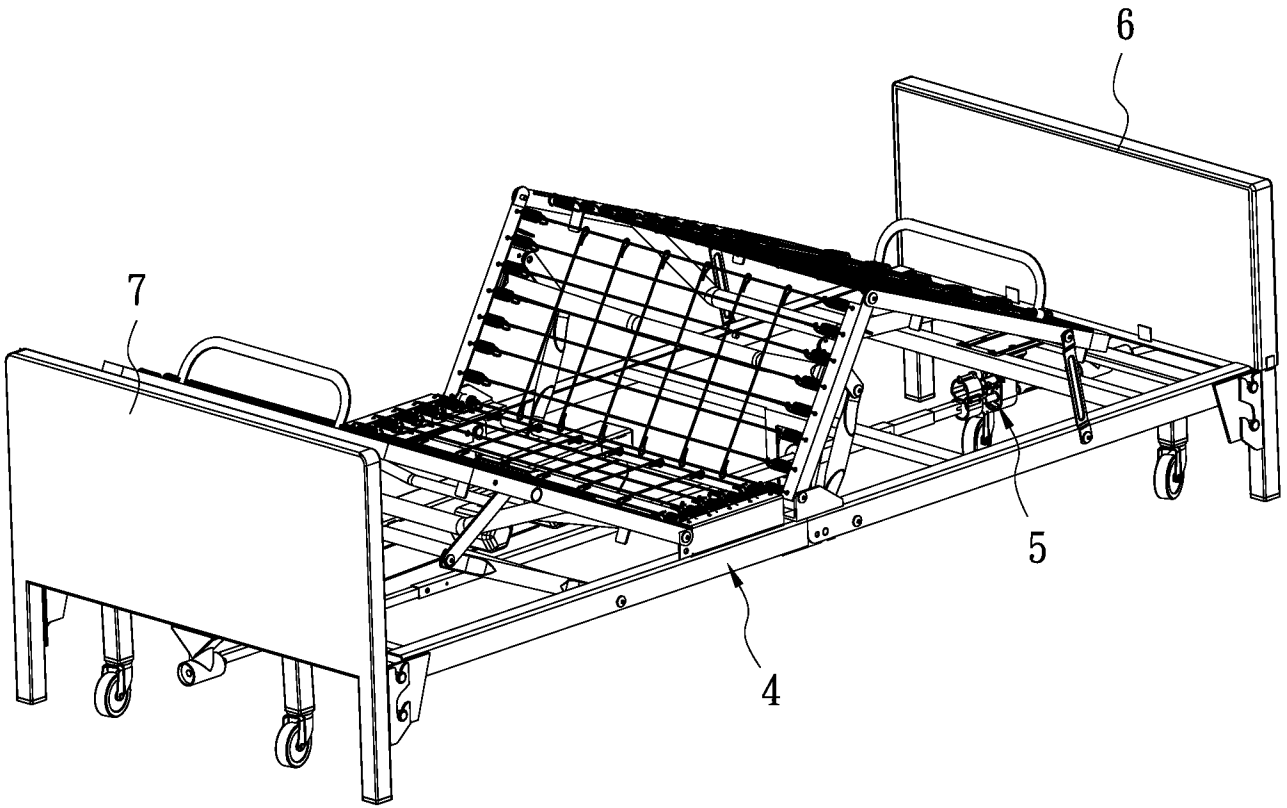
FIG. 2 is a perspective view of another conventional hospital bed.
Figure 3:
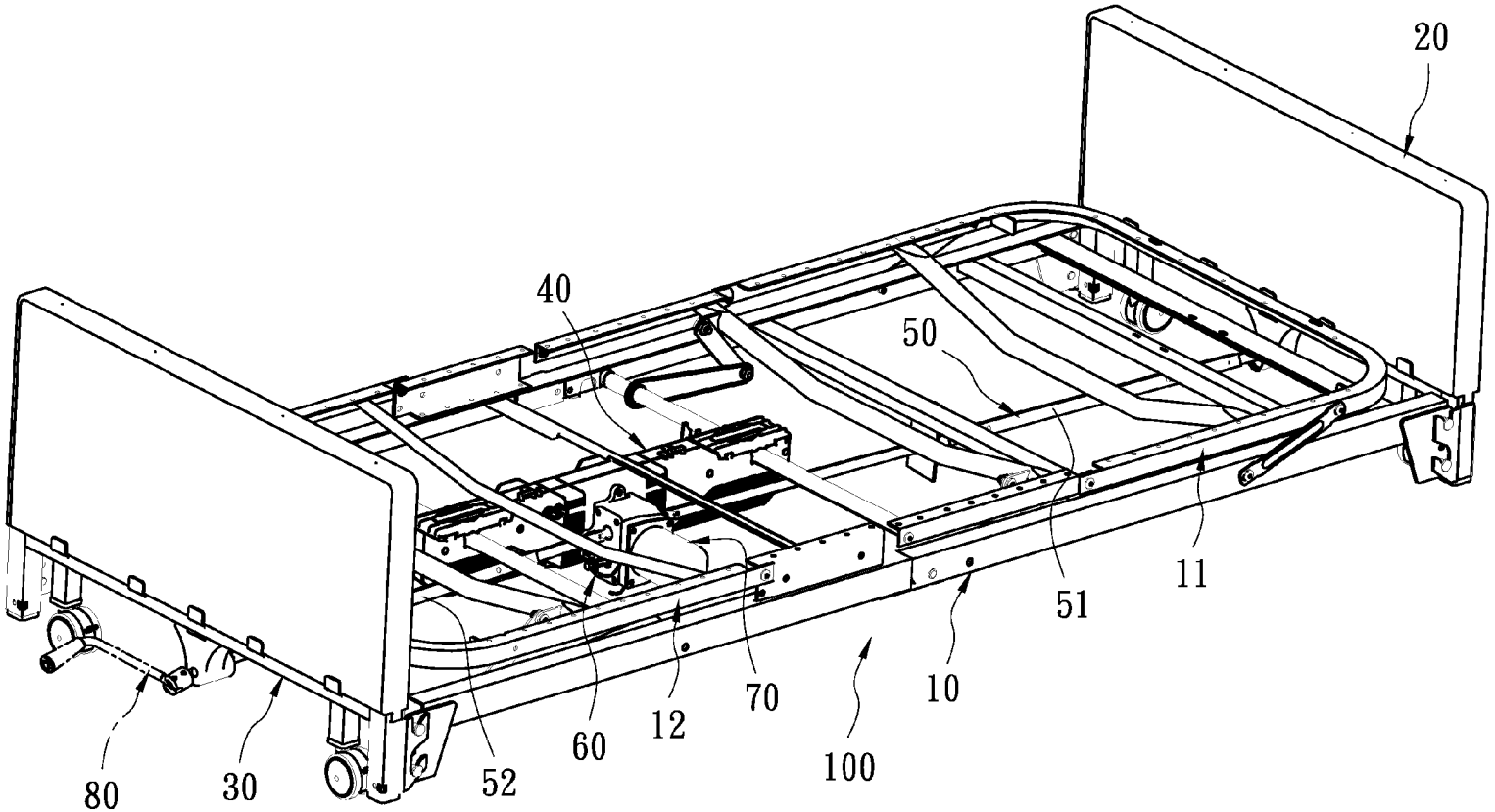
FIG. 3 is a perspective view of a hospital bed according to the first embodiment of the present invention.

Referring to FIGS. 3 through 8, there is shown a hospital bed 100 in accordance with a first embodiment of the present invention. The hospital bed 100 includes a frame 10, a head board 20, a foot board 30 and an apparatus for lifting and lowering the head board 20 and the foot board 30. A matrix or pad is supported on the frame 10 when the hospital bed 100 is in use. The apparatus includes a first motor unit 40, a shaft unit 50, a gear box 60 a second motor unit 70 and a crank 80.

The hospital bed 100 further includes a torso-supporting unit 11 pivotally connected to the frame 10 and a leg-supporting unit 12 pivotally connected to the frame 10. The head board 20 is movably connected to an end of the frame 10 while the foot board 30 is movably connected to an opposite end of the frame 10.

The first motor unit 40 is provided beneath the frame 10. Furthermore, the first motor unit 40 is connected to the torso-supporting unit 11 and the leg-supporting unit 12 through a linkage. The first motor unit 40 is electrically connected to an external control interface device such as remote controller. Thus, the remote controller is operable to actuate the first motor unit 40 to pivot up and down the torso-supporting unit 11 and the leg-supporting unit 12 through the leakage. How the torso-supporting unit 11 and the leg-supporting unit 12 are pivoted up and down will not be described in detail for not being the spirit of the present invention. However, it should be noted that the first motor unit 40 includes a pair of sockets 41 exposed to the exterior.

The shaft unit 50 includes a first shaft 51 and a second shaft 52. The first shaft 51 is connected to the head board 20 while the second shaft 52 is connected to the foot board 30. Both of the first shaft 51 and the second shaft 52 are in the form of a telescopic shaft that includes a plurality of tubes partially inserted in one another. Thus, both of the first shaft 51 and the second shaft 52 can be extended and shrunk. Moreover, the second shaft 52 is connected to the crank 80 that can be operated to lift and lower the head board 20 and the foot board 30 manually.

Figure 4:
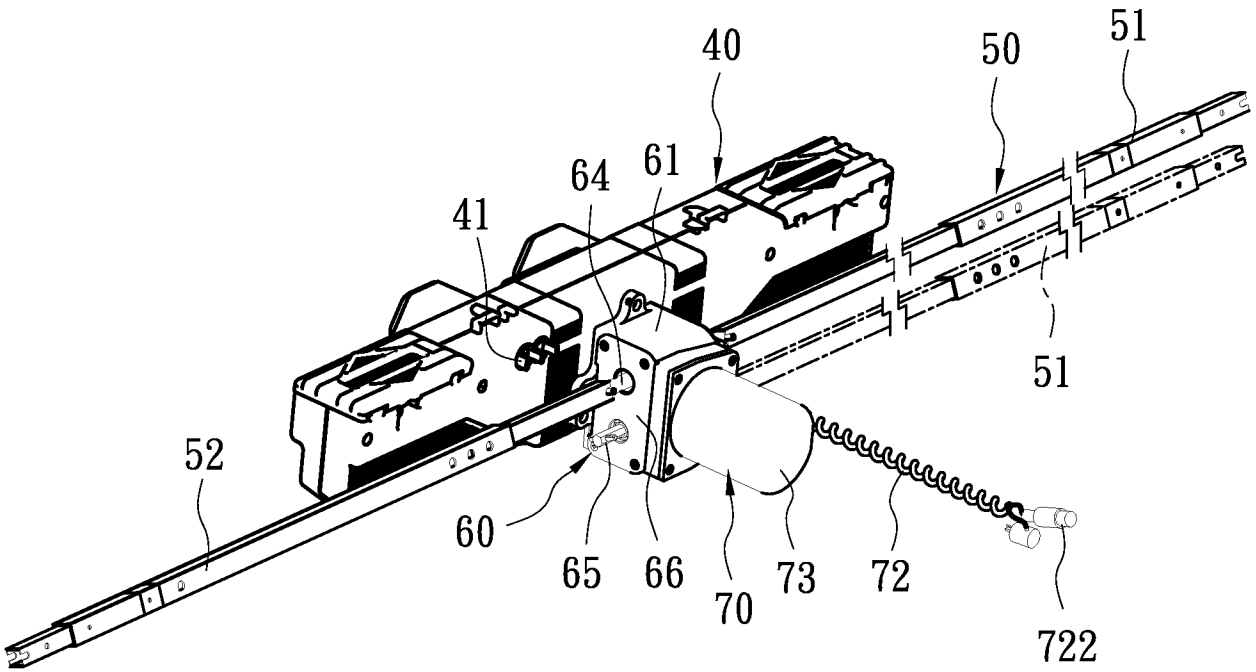
FIG. 4 is a perspective view of an apparatus for lifting and lowering a head board and a foot board of the hospital bed shown in FIG. 3.
Figure 5:
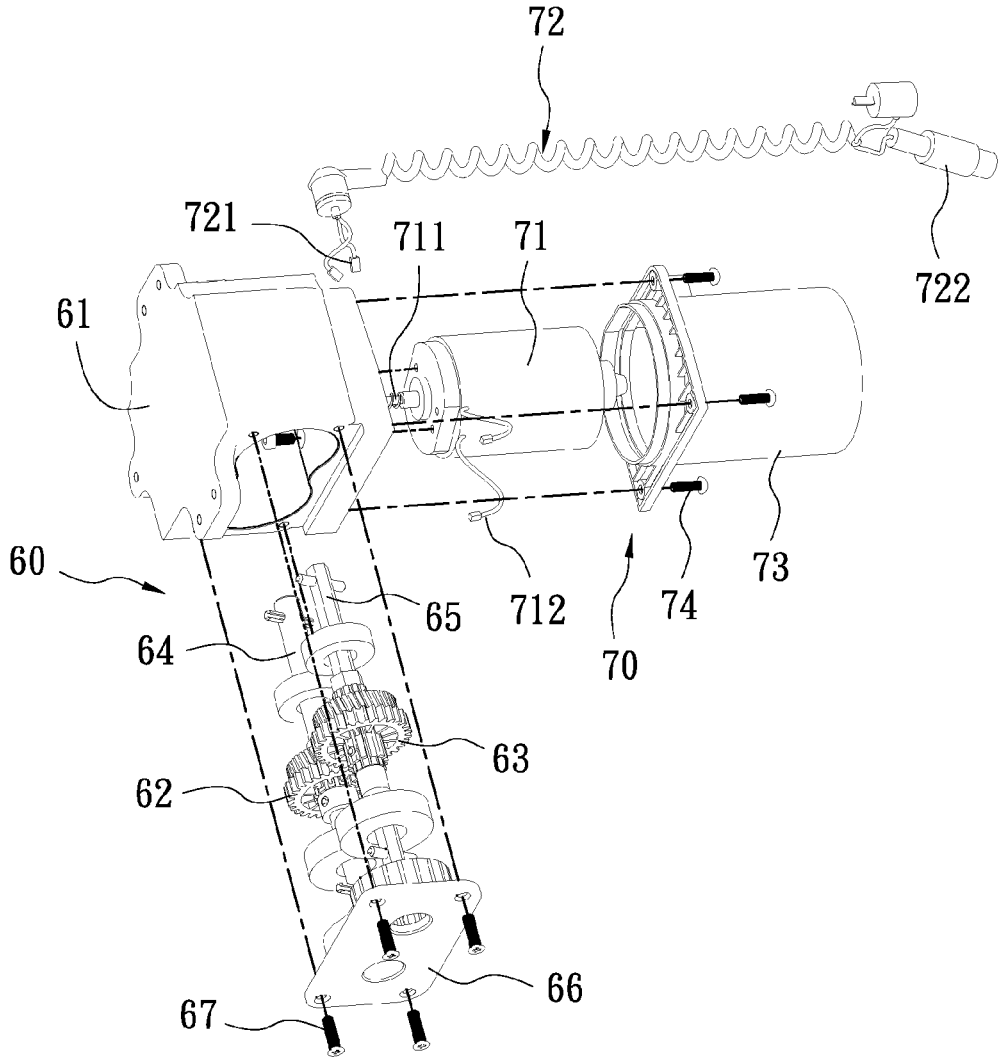
FIG. 5 is an exploded view of the apparatus shown in FIG. 4.

Referring to FIGS. 4 and 5, the gear box 60 is provided on a side of the first motor unit 40 and connected to the shaft unit 50 for lifting and lowering the head board 20 and the foot board 30. The gear box 60 includes a shell 61, a the first gear 62, a second gear 63, a first axle 64, a second axle 65 and a cover 66. The first gear 62 is provided on the first axle 64 while the second gear 63 is provided on the second axle 65. The first gear 62 is engaged with the second gear 63. The cover 66 is attached to the shell 61 by a plurality of screws 67 after the first gear 62 and the second gear 63 are located in the shell 61 and the first axle 64 and the second axle 65 are inserted through the shell 61. However, each of the first axle 64 and the second axle 65 includes two ends extending beyond the shell 61 and the cover 66.

In the first embodiment, the first axle 64 of the gear box 60 is a circular rod while the second axle 65 of the gear box 60 is a hexagonal rod.

The second motor unit 70 includes a motor 71, a pair of wires 72 and a shell 73. The motor 71 is provided in the shell 73. The shell 73 of the second motor unit 70 is secured to the shell 61 of the gear box 60 by several screws 74. The motor 71 includes a mandrel 711 and a pair of leads 712. Each of the wires 72 includes a first end 721 and a second end 722. The first end 721 of each of the wires 72 is electrically connected to a related one of leads 712 of the motor 71 in a plug-and-socket manner. The second end 722 of each of the wires 72 is inserted in a related one of the sockets 41 of the first motor unit 40. The mandrel 711 is engaged with both of the first gear 62 and the second gear 63 of the gear box 60.

Figure 6:
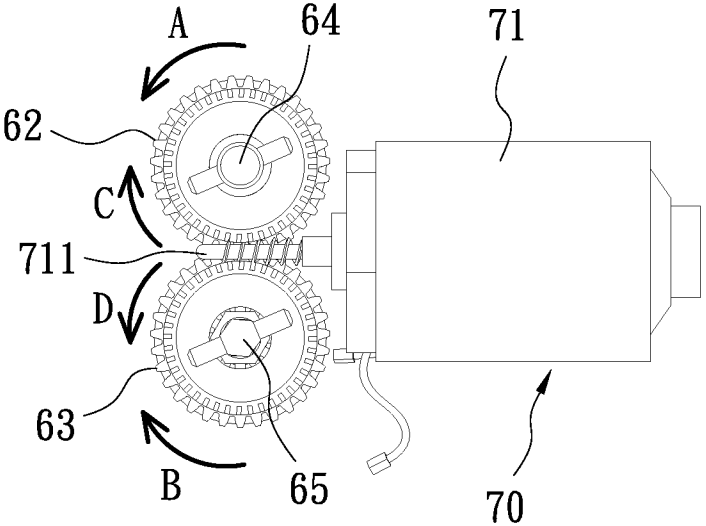
FIG. 6 is a partial, front view of the apparatus shown in FIG. 4.
Figure 7:
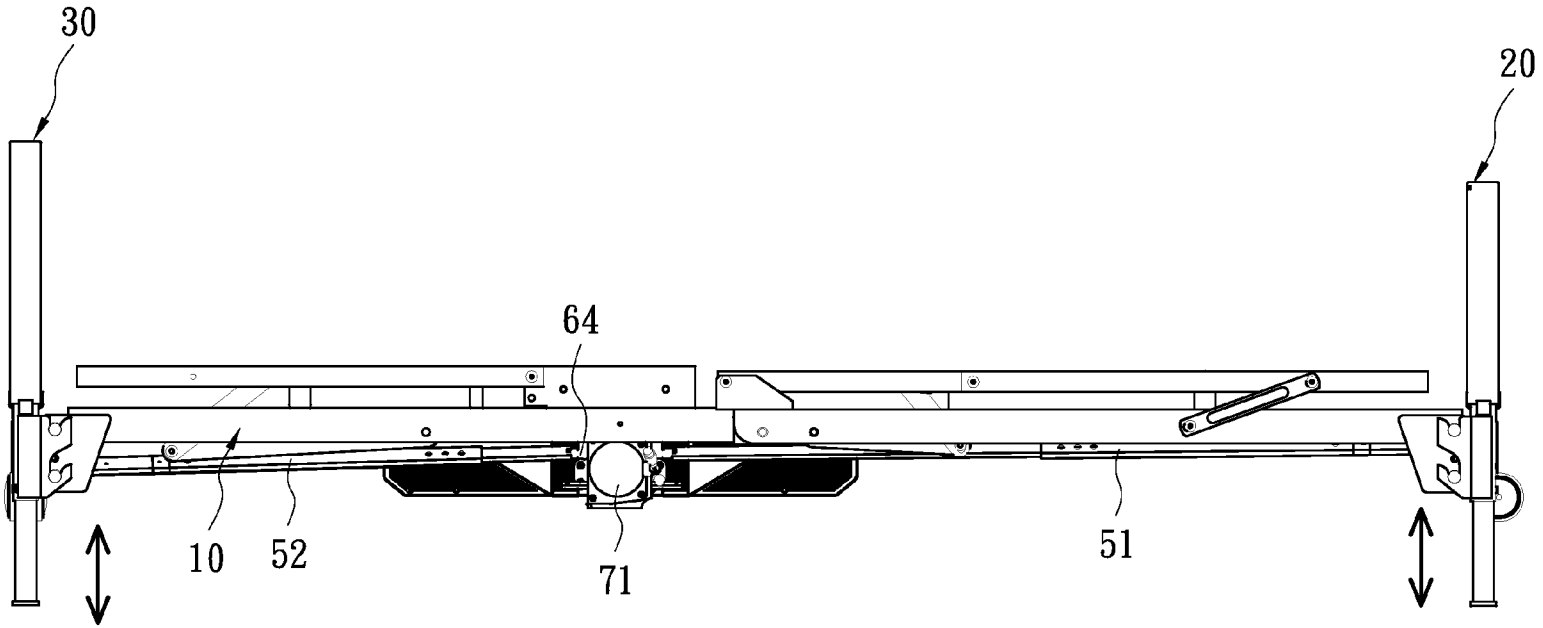
FIG. 7 is a side view of the hospital bed shown in FIG. 3.

Referring to FIGS. 4, 6 and 7, to lift and lower the head board 20 and the foot board 30 synchronously, both of the first shaft 51 and the second shaft 52 are connected to the first axle 64. The mandrel 711 of the motor 71 is used to rotate the first gear 62 and the second gear 63. As the first gear 62 is rotated clockwise as indicated by an arrow head A, the second gear 63 is rotated counterclockwise as indicated by an arrow head B. Now, the head board 20 and the foot board 30 are lowered synchronously. That is, the frame 10 is lifted since both of the boards 20 and 30 are located on the ground or a floor. As the first gear 62 is rotated counterclockwise as indicated by an arrow head C, the second gear 63 is rotated clockwise as indicated by an arrow head D. Now, the head board 20 and the foot board 30 lifted synchronously. That is, the frame 10 is lowered.

Figure 8:
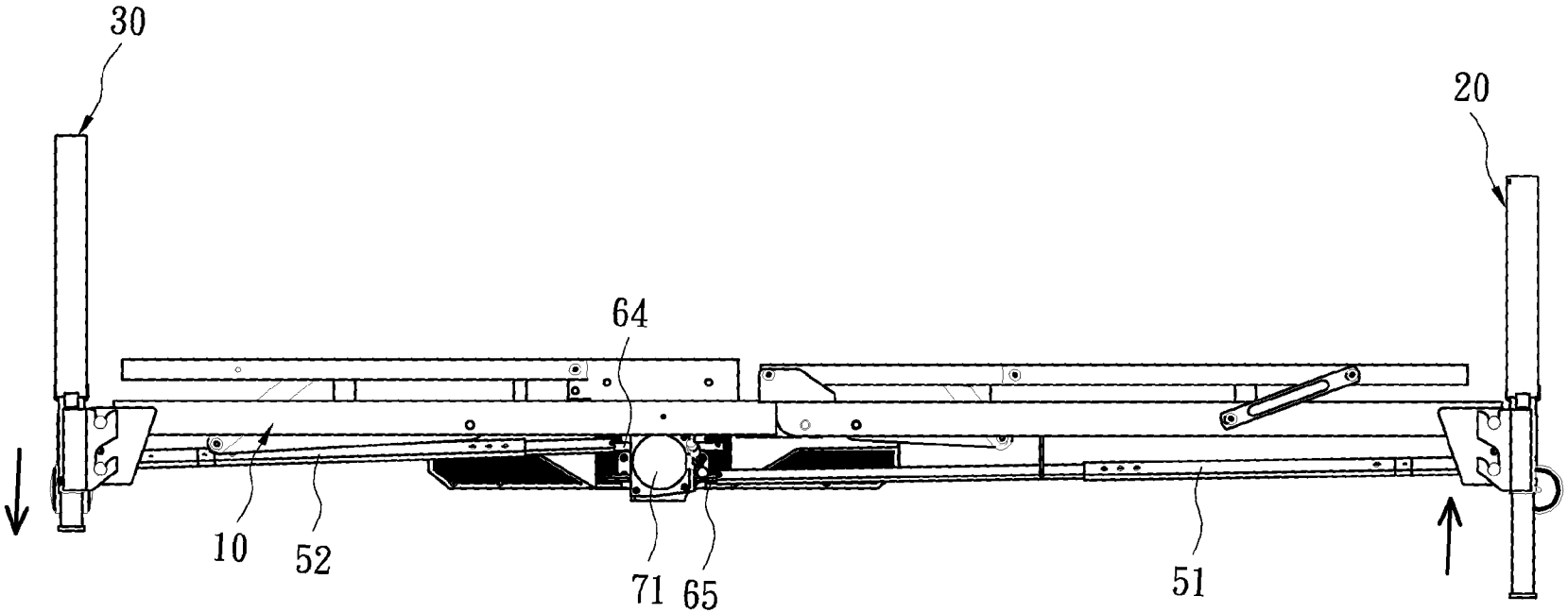
FIG. 8 is a side view of the hospital bed in another position than shown in FIG. 7.

Referring to FIGS. 4, 6 and 8, to lift or lower the head board 20 but lower or lift the foot board 30, the first shaft 51 is connected to the second axle 65 while the second shaft 52 is connected to the first axle 64 as shown by phantom lines in FIG. 4. The mandrel 711 of the motor 71 is used to rotate the first gear 62 and the second gear 63. As the first gear 62 is rotated clockwise as indicated by an arrow head A, the second gear 63 is rotated counterclockwise as indicated by an arrow head B. Now, the foot board 30 is lowered while the head board 20 is lifted. That is, the frame 10 is tilted in a direction. As the first gear 62 is rotated counterclockwise as indicated by an arrow head C, the second gear 63 is rotated clockwise as indicated by an arrow head D. Now, the foot board 30 is lifted while the head board 20 is lowered. That is, the frame 10 is tilted in an opposite direction.

Figure 10:
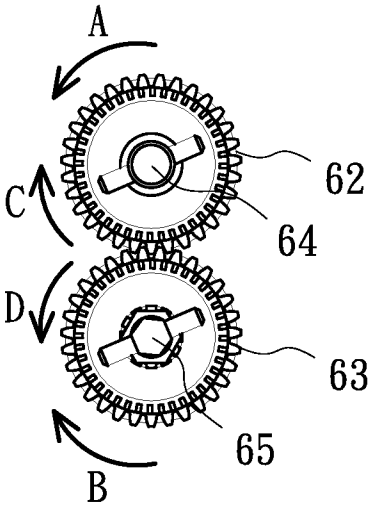
FIG. 10 is a partial, front view of the apparatus shown in FIG. 9.
Figure 9:
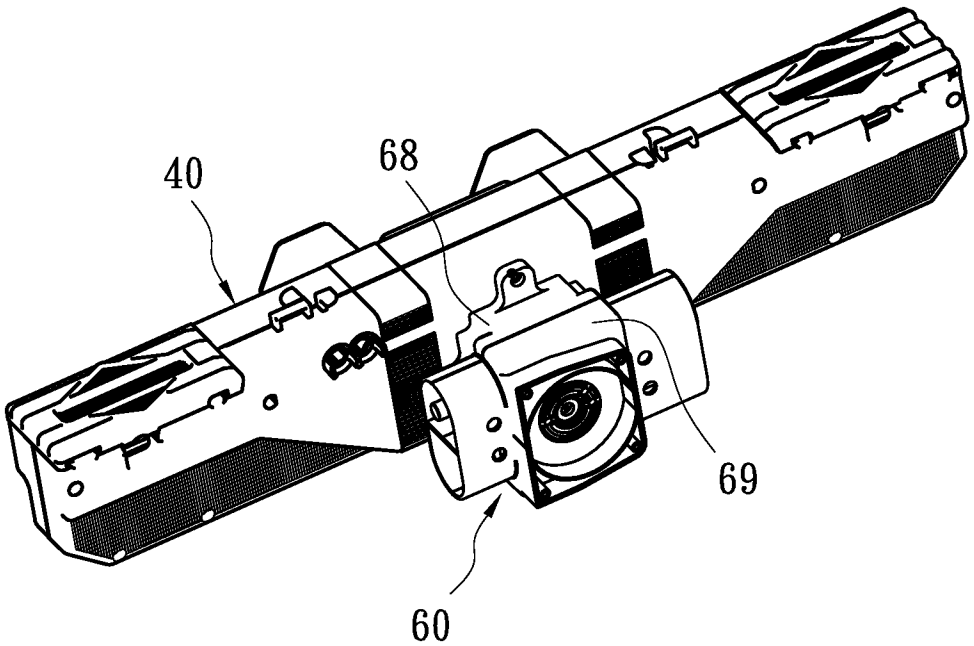
FIG. 9 is a perspective view of an apparatus for lifting and lowering a head board and a foot board of a hospital bed shown according to the second embodiment of the present invention.

Referring to FIGS. 9 and 10, there is shown a hospital bed according to a second embodiment of the present invention. The second embodiment is like the first embodiment except for two things. At first, the apparatus for lifting and lowering the head board 20 and the foot board 30 does not include the second motor unit 70. That is, the apparatus for lifting and lowering the head board 20 and the foot board 30 only includes the first motor unit 40, the shaft unit 50, the gear box 60 and the crank 80. Secondly, the gear 60 includes a shell 68 and a cover 69 instead of the shell 61 and the cover 66. The shell 68 is close to the cover 69 in size. The shell 61 is much bigger than the cover 66 in size.

Referring to FIG. 10, the first gear 62 is rotated clockwise as indicated by the arrow head A while the second gear 63 is rotated counterclockwise as indicated by the arrow head B. The first gear 62 is rotated counterclockwise as indicated by the arrow head C while the second gear 63 is rotated clockwise as indicated by the arrow head D. Therefore, based on the different manners in which the shaft unit 50 is connected to gear box 60, there are two modes for the lifting and lowering of the head board 20 and the foot board 30. In the first mode, the head board 20 and the foot board 30 are synchronously lifted and lowered. In the second mode, the head board 20 is lifted (or lowered) while the foot board 30 is lowered (or lifted). The operation of the shaft unit 50 and the gear box 60 is identical as shown in FIGS. 7 and 8.

As discussed above, the hospital bed of the present invention exhibits at least three advantages.

At first, the first motor unit 40, the gear box 60 and the second motor unit 70 are connected to one another like one so that the head board 20 and the foot board 30 can be lifted and lowered and that the modularization of the motor units 40 and 70 makes it easy to transport the apparatus.

Secondly, by switching the manners in which the shaft unit 50 is connected to gear box 60, the hospital bed 100 can easily be switch between two modes. In the first mode, the frame 10 is lowered or lifted or lowered on the head board 20 and the foot board 30 as the head board 20 and the foot board 30 are synchronously lowered and lifted relative to the frame 10. In the second mode, the frame 10 is tilted as the head board 20 is lifted (or lowered) while the foot board 30 is lowered (or lifted) relative to the frame 10.

Thirdly, the first motor unit 40 and the second motor unit 70 are provided beneath the frame 10 so that the hospital bed 100 looks neat and the first motor unit 40 and that the second motor unit 70 are protected during transportation.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A hospital bed comprising:

a frame, a torso-supporting unit pivotally connected to the frame, a leg-supporting unit pivotally connected to the frame, a head board, a foot board and an apparatus for lifting and lowering the head board and the foot board, wherein the apparatus includes:

a first motor unit provided beneath the frame for driving the torso-supporting unit and the leg-supporting unit so as to rotate and tilt through a linkage, and the first motor unit being connected to the torso-supporting unit and the leg-supporting unit through the linkage and being electrically connected to a remote controller so that the remote controller is operable to actuate the first motor unit to pivot up and down the torso-supporting unit and the leg-supporting unit through the linkage;

a shaft unit including a first shaft connected to the head board and a second shaft connected to the foot board;

a gear box provided on a side of the first motor unit and connected to the shaft unit for lifting and lowering the head board and the foot board, and the gear box including a first axle and a second axle;

a second motor unit provided on a side of the gear box, wherein the second motor unit includes:

a motor provided with a mandrel engaged with the gear box; and a pair of wires for electrically connecting the motor of the second motor unit to the first motor unit, wherein the second motor unit lifts and lowers the head board and the foot board through the gear box and the shaft unit;

wherein the head board and the foot board are lifted and lowered synchronously when the first shaft and the second shaft are connected to the first axle;

wherein the foot board is lowered when first shaft is connected to the second axle, the second shaft is connected to the first axle, and the head board is lifted;

wherein the foot board is lifted when first shaft is connected to the second axle, the second shaft is connected to the first axle, and the head board is lowered.

2. The hospital bed according to claim 1, wherein the first motor unit includes a pair of sockets, wherein the motor of the second motor unit is provided with a pair of leads, wherein each of the wires of the second motor unit includes a first end inserted in a related one of the sockets of the first motor unit and a second end connected to a related one of the leads of the motor of the second motor unit.

3. The hospital bed according to claim 2, wherein the second end of each of the wires is connected to the lead of the motor of the second motor unit in a plug-and-socket manner.

4. The hospital bed according to claim 1, wherein the gear box also includes:

a shell through which the first axle and the second axle are inserted;

a first gear provided on the first axle;

a second gear provided on the second axle; and a cover for protectively covering the first and second gears and sections of the first and second axles in the shell.

5. The hospital bed according to claim 1, wherein the first axle of the gear box is a circular rod.

6. The hospital bed according to claim 1, wherein the first axle of the gear box is a hexagonal rod.

* * * * *